US006406244B1

(12) United States Patent
Le Riche

(10) Patent No.: US 6,406,244 B1
(45) Date of Patent: Jun. 18, 2002

(54) STACK OF SHEETS WITH REPOSITIONABLE ADHESIVE ALTERNATING BETWEEN OPPOSITE EDGES AND CONTAINING ONE OR MORE SHEETS DIFFERENT FROM OTHER SHEETS

(76) Inventor: Frederic P. A. Le Riche, P.O. Box 33427, St. Paul, MN (US) 55133-3427

( * ) Notice: Subject to any disclaimer, the term of this patent is extended or adjusted under 35 U.S.C. 154(b) by 0 days.

(21) Appl. No.: 09/445,407

(22) PCT Filed: Jul. 9, 1998

(86) PCT No.: PCT/US98/14319

§ 371 (c)(1),
(2), (4) Date: Dec. 6, 1999

(87) PCT Pub. No.: WO99/02351

PCT Pub. Date: Jan. 21, 1999

(51) Int. Cl.[7] ..... B42C 9/00

(52) U.S. Cl. ..... 412/37; 281/5; 412/9; 412/20; 412/901; 427/209; 428/355 RA

(58) Field of Search ..... 281/2, 5, 9; 221/33; 283/61, 62, 101; 462/66, 84, 900; 428/40.1, 343, 355 RA; 412/37, 9, 18, 20, 28, 33, 901; 427/209

(56) References Cited

U.S. PATENT DOCUMENTS

| | | | | |
|---|---|---|---|---|
| 1,781,877 | A | 11/1930 | Levin | |
| 2,060,800 | A | 11/1936 | Ehrig et al. | 271/28 |
| 2,130,605 | A | 9/1938 | Staude | 91/68 |
| 2,146,945 | A | 2/1939 | Ehrig et al. | 271/12 |
| 2,647,463 | A | 8/1953 | Ferrar | 101/419 |
| 3,029,731 | A | 4/1962 | Bussey | 101/419 |
| 3,257,226 | A | 6/1966 | Thwaites | 117/64 |
| 3,407,084 | A | 10/1968 | Heywood | 117/44 |
| 3,467,060 | A | 9/1969 | Klebanow et al. | 118/58 |
| 3,565,728 | A | 2/1971 | Alton | 156/566 |

(List continued on next page.)

FOREIGN PATENT DOCUMENTS

| | | | |
|---|---|---|---|
| DE | 31 21 992 | A1 | 12/1982 |
| DE | 36 06 199 | A1 | 8/1987 |
| DE | 36 28 784 | A1 | 3/1988 |
| DE | 36 32 816 | A1 | 3/1988 |
| EP | 0 163 127 | A1 | 12/1985 |
| EP | 0 395 295 | A1 | 10/1990 |
| EP | 0 270 833 | B1 | 9/1991 |
| EP | 0890451 | A1 * | 7/1997 |
| EP | 0 684 974 | B1 | 4/1998 |
| EP | 0 879 713 | A1 | 11/1998 |

(List continued on next page.)

OTHER PUBLICATIONS

Zink, Stanley C., "Coating Process," *Kirk–Othmer Encyclopedia of Chemical Technology*, vol. 6, p. 386–426, 1979.

"Adhesive Sheets," *Journal of Adhesion and Sealing*, vol. 28, No. 2, p. 29–33, 1984 (w/abstract).

Kettleboroagh, A.J., "Water–Based Adhesives: Past, Present and Future," *Advances in Adhesives: Applications, Materials and Safety*, p. 123–130, 1983.

"Gravure Coaters," *Handbook of Pressure Sensitive Adhesive Technology*, p. 789–792.

*Primary Examiner*—A. L. Wellington
*Assistant Examiner*—Monica Carter
(74) *Attorney, Agent, or Firm*—Carolyn V. Peters

(57) ABSTRACT

The present invention provides a stack of flexible sheet material comprising a plurality of sheets disposed one on top of another, each sheet having repositionable adhesive along one edge and being free of adhesive along the opposite edge and the sheets are stacked with the repositionable adhesive edge of each sheet disposed along alternate opposite edges to maintain the sheets in the stack, characterized in that the stack comprises at least two sheets that are different from each other. The present invention also provides a method and apparatus for obtaining a stack of sheets as defined above and a dispenser comprising a stack of sheets as defined above.

5 Claims, 10 Drawing Sheets

U.S. PATENT DOCUMENTS

| | | | | | |
|---|---|---|---|---|---|
| 4,004,061 | A | * | 1/1977 | Creighton et al. | 428/349 |
| 4,214,743 | A | | 7/1980 | Meier | 271/182 |
| 4,325,321 | A | | 4/1982 | Wahnschaff | 118/245 |
| 4,399,767 | A | | 8/1983 | Simeth | 118/46 |
| 4,416,392 | A | * | 11/1983 | Smith | 221/45 |
| 4,416,448 | A | | 11/1983 | Meier | 270/55 |
| 4,526,362 | A | | 7/1985 | Thierstein | 271/186 |
| 4,558,888 | A | | 12/1985 | Hanson et al. | 281/23 |
| 4,664,949 | A | | 5/1987 | Greiner et al. | 427/210 |
| 4,779,557 | A | | 10/1988 | Frazzitta | 118/46 |
| 4,781,306 | A | * | 11/1988 | Smith | 221/33 |
| 5,009,408 | A | | 4/1991 | Pulskamp | 270/57 |
| 5,029,832 | A | | 7/1991 | Orsinger et al. | 270/54 |
| 5,040,778 | A | | 8/1991 | Cole, Jr. | 271/65 |
| 5,067,699 | A | | 11/1991 | Gadway et al. | 270/55 |
| 5,080,254 | A | * | 1/1992 | Feer | 221/33 |
| 5,143,250 | A | * | 9/1992 | Freitag | 221/59 |
| 5,167,346 | A | * | 12/1992 | Bodziak | 221/63 |
| 5,363,985 | A | * | 11/1994 | Cornell | 221/46 |
| 5,382,055 | A | | 1/1995 | Mertens et al. | 283/67 |
| 5,397,117 | A | | 3/1995 | Mertens | 221/34 |
| 5,409,208 | A | | 4/1995 | Schmid | 271/204 |
| 5,417,345 | A | * | 5/1995 | Smith | 221/33 |
| 5,487,780 | A | | 1/1996 | Ritter | 118/231 |
| 5,618,062 | A | | 4/1997 | Mertens et al. | 283/67 |
| 5,849,358 | A | * | 12/1998 | Le Riche et al. | 427/211 |
| 5,851,592 | A | * | 12/1998 | Le Riche et al. | 427/350 |
| 5,863,330 | A | * | 1/1999 | Le Riche et al. | 118/248 |
| 5,868,838 | A | * | 2/1999 | Le Riche et al. | 118/236 |
| 5,916,630 | A | * | 6/1999 | Le Riche et al. | 427/209 |
| 5,958,135 | A | * | 9/1999 | Pierre | 118/227 |
| 5,972,113 | A | * | 10/1999 | Le Riche et al. | 118/643 |
| 6,040,006 | A | * | 3/2000 | Le Riche et al. | 427/209 |
| 6,074,704 | A | * | 6/2000 | Le Riche et al. | 427/428 |
| 6,153,278 | A | * | 11/2000 | Timmerman et al. | 428/40.1 |

FOREIGN PATENT DOCUMENTS

| | | |
|---|---|---|
| EP | 0 890 451 A1 | 1/1999 |
| GB | 2 166 717 A | 5/1986 |
| GB | 2 246 423 A | 1/1992 |
| GB | 2 248 412 A | 4/1992 |
| JP | 50-79534 | 6/1975 |
| JP | 52-123437 | 10/1977 |
| JP | 57-12084 | 1/1982 |
| JP | 57-115479 | 7/1982 |
| JP | 2-252531 | 10/1990 |
| JP | 5-178530 | 7/1993 |
| WO | WO 87/05315 | 9/1987 |
| WO | WO 94/19419 | 9/1994 |
| WO | WO 96/05065 | 2/1996 |
| WO | WO 96/05066 | 2/1996 |
| WO | WO 97/29985 | 8/1997 |

* cited by examiner

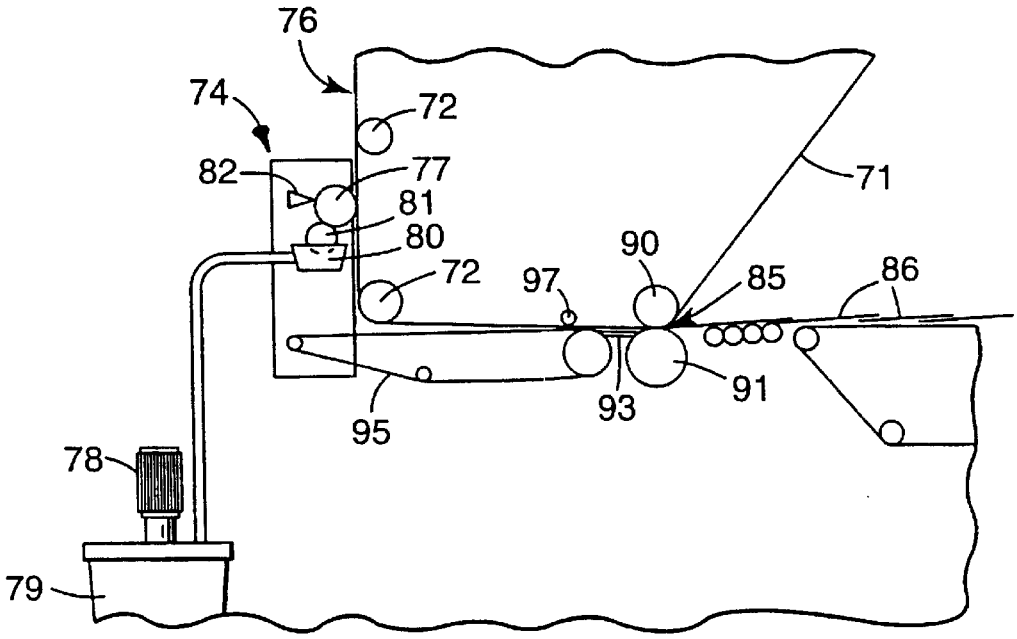
FIG. 10a
FIG. 11
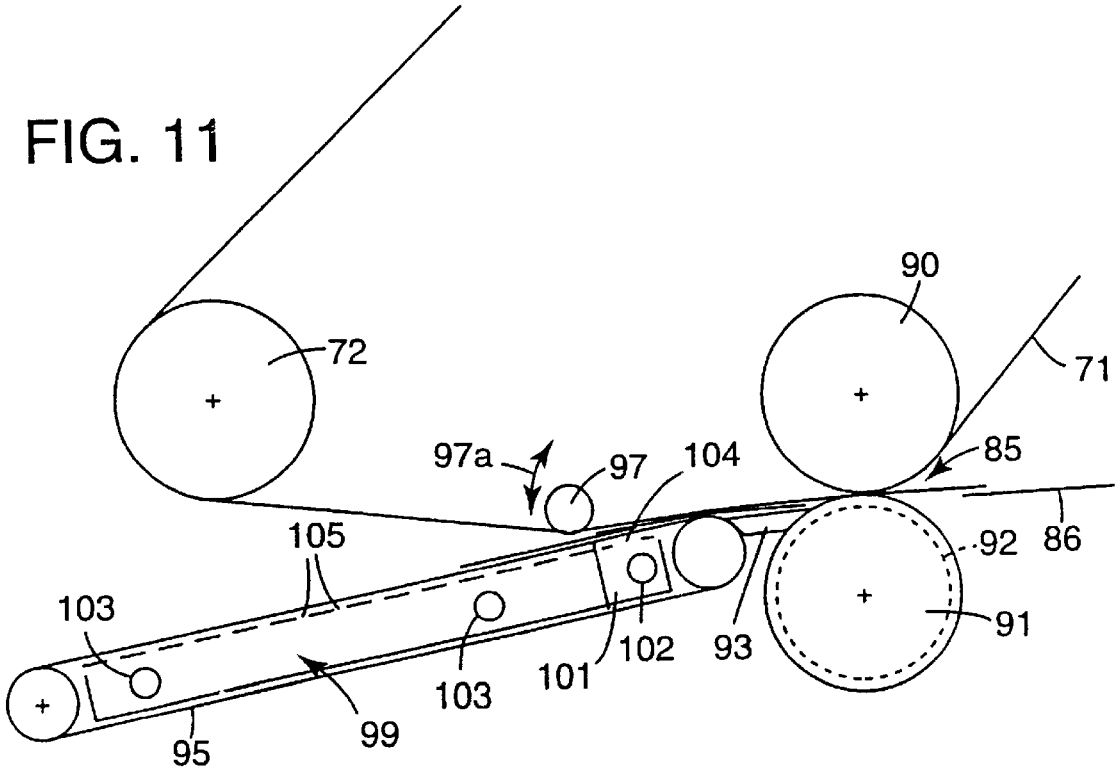

STACK OF SHEETS WITH REPOSITIONABLE ADHESIVE ALTERNATING BETWEEN OPPOSITE EDGES AND CONTAINING ONE OR MORE SHEETS DIFFERENT FROM OTHER SHEETS

TECHNICAL FIELD

The present invention relates to a stack of flexible sheet material and to a dispenser containing such stack. The stack contains a plurality of sheets with each sheet attached to the other by repositionable adhesive and wherein at least two sheets are different from each other. The present invention farther relates to a method for applying coating material to a plurality of sheets of which at least two sheets are different and to an apparatus for carrying out that method.

BACKGROUND OF THE INVENTION

U.S. Pat. No. 5,417,345 discloses a dispensing device for use in dispensing sheets of material coated along one edge with a narrow band of readily releasable pressure-sensitive adhesive. The dispenser comprises a container having a pair of sidewalls connected by a top wall which is formed with a transversely extending rectangular opening extending in the direction parallel to the side walls. The sheets are stacked within the dispenser such that upon removing the uppermost sheet in the stack the adhesive coating along one edge of the sheet adhered to the edge of the next sheet in the stack will cause the next sheet in the stack to be withdrawn at that free edge through the dispensing opening upon withdrawal of the uppermost sheet. A typical embodiment disclosed includes a stack of sheets where the adhesive alternates between two opposite edges of the stack. Further, dispensers such as those disclosed in this patent are commercially available. However, a stack of sheets used therein typically consists of sheets that are all similar.

There exists now a desire to have one or more sheets in the stacks of such dispensers to be different from the other sheets in the stack. For example, it may be desirable to have sheets of alternating color in the stack or to have one or more sheets in the stack that contain a message, in particular an advertisement or an indication that the end of the stack is approaching.

It has however until now not been possible to produce such stacks of sheets where the adhesive alternates between opposite edges. In particular, a stack of sheets as disclosed in U.S. Pat. No. 5,417,345 is typically prepared by coating the adhesive stripes to a continuous web of sheet material, for example paper. Such process does not give the required flexibility needed to produce stacks in which one or more sheets are different from the other sheets.

WO 94/19419 discloses a process for coating a plurality of individual sheets with adhesive, for example repositionable adhesive. This process allows for one or more sheets, different from the other sheets to be inserted during the coating process thereby allowing to produce a stack of sheets with inserts. However, the process disclosed in this patent application is not adapted to produce stacks of sheets where the adhesive alternates between opposite edges of the stack and that can be used in a dispenser such as disclosed in the above U.S. Pat. No. 5,417,345.

SUMMARY OF THE INVENTION

The present invention provides a stack of flexible sheet material comprising a plurality of sheets disposed one on top of another, each sheet having repositionable adhesive along one edge and being free of adhesive along the opposite edge and the sheets are stacked with the repositionable adhesive edge of each sheet disposed along alternate opposite edges to maintain the sheets in the stack, characterised in that said stack comprises at least two sheets that are different from each other.

The present invention also provides a dispenser comprising a stack of sheets as defined above, said dispenser having wall means enclosing the stack including a top wall with a transverse opening through which a portion at the edge free of adhesive of the uppermost sheet in the stack extends.

The present invention further provides a method for applying coating material to sheets, comprising the steps of:

(a) applying coating material to an endless transfer surface;

(b) conveying a plurality of sheets, of which at least two sheets are different from each other, in an overlapped end-to-end relationship to a transfer location; and (c) contacting the sheets at the transfer location with the transfer surface to transfer the coating material to the sheets thereby obtaining a coated area on each of said sheets;

wherein said coating material is applied to said endless transfer surface such that when coating material is transferred to a first and second sheet that are next to each other, the coated areas on said first and second sheets are offset relative to each other in the direction perpendicular to the direction of conveyance of the sheets.

Also provided is an apparatus for applying coating material to a plurality of sheets, the apparatus including a conveyor arrangement for conveying a plurality of sheets in overlapped end-to-end relationship to a transfer location;

an endless transfer surface which is movable through the transfer location in contact with the conveyed sheets;

and a coating means arranged to apply, to the endless transfer surface, coating material for subsequent transfer to sheets to form coated areas thereon at the transfer location;

wherein said coating means is capable of applying coating material to said endless transfer surface in such a way that when coating material is transferred to a first and second sheet that are next to each other, the coated areas on said first and second sheets are offset relative to each other in the direction perpendicular to the direction of conveyance of the sheets.

BRIEF DESCRIPTION OF THE DRAWINGS

Embodiments of the invention will be described, by way of example, with reference to the accompanying drawings, wherein like structure is referred to by like numerals in the several views, and in which:

FIG. 10*a* is a diagrammatic side view of part of an adhesive coater forming part of the apparatus shown in FIG. 1;

FIG. 11 is an enlarged partial view illustrating, diagrammatically, a part of FIG. 10*a;*

DETAILED DESCRIPTION

Figure 1:
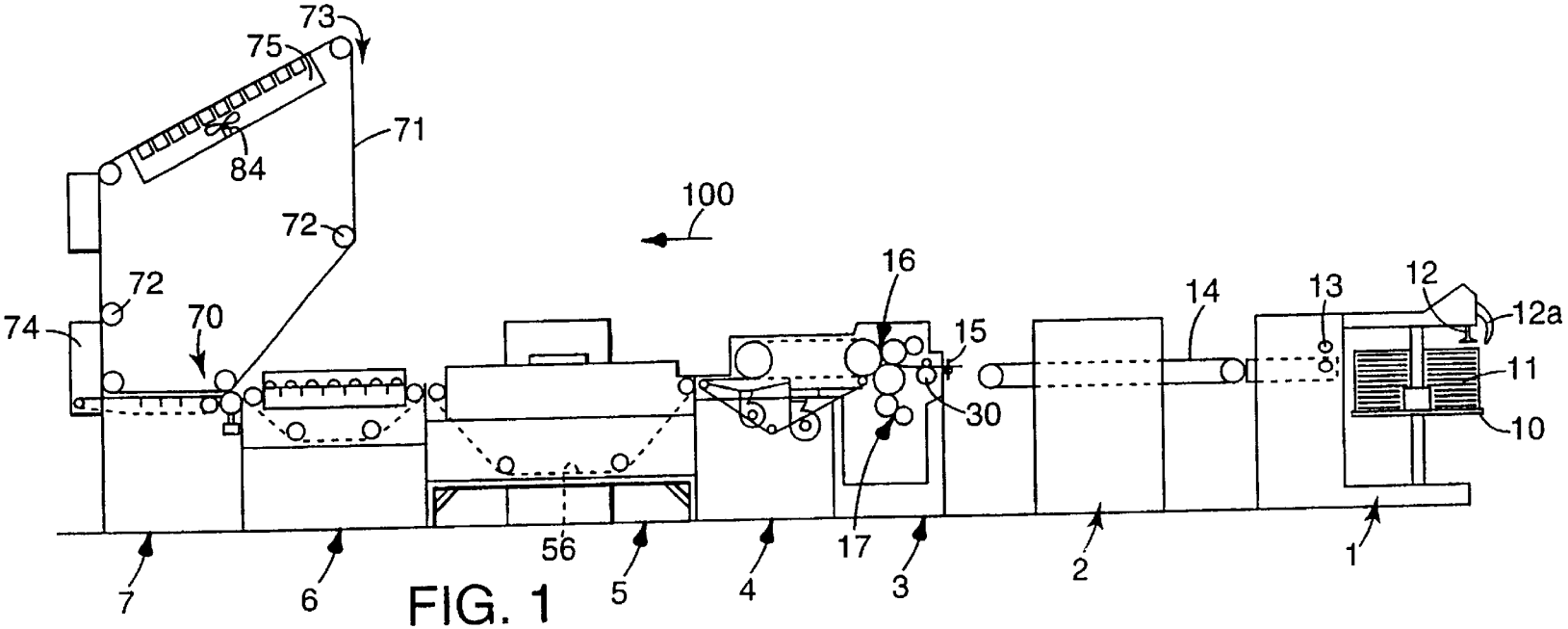
FIG. 1 is a schematic side view of sheet coating apparatus in accordance with the invention.

The flexible sheet material for use in connection with the present invention can be any kind of flexible material and includes paper as well as plastic film materials such as polyethylene, polypropylene and polyester. Preferably the flexible sheet material is paper and the description will be primarily directed thereto without however the intention to limit the invention thereto. Preferably, the stack of flexible sheet material is a stack of repositionable notes. Preferably, such notes are coated on one surface with a primer coating and on the other side with a low adhesion backsize (LAB). The repositionable adhesive is coated to the surface coated with the primer coating. The primer material may be obtained by mixing approximately 3–7% by weight of the binding agent MOWIOL (Trade Mark) available from Hoechst AG, Frankfurt/Main, Germany and approximately 3–8% by weight of the pigment AEROSIL (Trade Mark) available from Degussa AG, Frankfurt/Main, Germany with approximately 90% by weight of water.

The LAB material may be any suitable material including, but not limited to, acrylate co-polymers, silicone materials, urethanes, and fluoro polymers. For example, the LAB may be a water-based solution of the material described in EP-A-0618509, the solution comprising typically from about 5% to about 10% solid material. Other LAB materials that may be employed include those disclosed in U.S. Pat. Nos. 5,202,190 and 5,032,460.

The repositionable adhesive is preferably a repositionable microsphere pressure-sensitive adhesive, for example as described in U.S. Pat. Nos. 5,045,569; 4,495,318; 4,166,152; 3,857,731; 3,691,140; US Re 24906; U.S. Pat. No. 5,571,617 and EP-A-0 439 941.

The sheets in the stack may be of any desired size and shape but are typically rectangular or square and have a width between 5 cm and 15 cm and a length between 5 cm and 25 cm. The number of sheets in the stack can vary widely but is typically between 10 and 100, preferably between 25 and 50.

The stack of this invention contains at least two sheets that are different from each other. While they may be different in any kind of respect they are preferably different in color, printing or kind of material. According to a particular embodiment of this invention, the stack contains a majority of sheets that are similar and only a few sheets that are different from that majority of sheets. Typically, these few sheets may contain messages such as an advertisement or an indication that the end of the stack is approaching. Alternatively, the stack comprises similar first sheets and similar second sheets and these first and second sheets differ from each other in for example color and are alternated throughout the stack.

The flexible sheet material in accordance with this invention has a first major surface and a second major surface opposite to the first major surface. Along one edge of the second major surface there is provided the repositionable adhesive preferably in the form of a band or stripe, although any other form can be used as well such as for example spots of repositionable adhesive. The sheets are stacked together with second major surface of one sheet adhering to first major surface of the next sheet in the stack and the adhesive coating alternates between two opposite edges of the stack. Accordingly, of two consecutive sheets of a stack one sheet in the stack will have the repositionable adhesive along a first edge of two opposite edges and will be free of repositionable adhesive along second edge of the two opposite edges and the next sheet in the stack will be free of repositionable adhesive along the first edge and have repositionable adhesive along the second edge.

The stack of flexible sheet material of this invention is typically used in a dispenser as described above. This adds an element of surprise to commercial advertisements contained on inserted sheets in the stack because such sheets only appear to a user when the previous sheet relative to the inserted sheet is withdrawn from the dispenser. Suitable dispensers for use in this invention are described in more detail in U.S. Pat. No. 5,417,345.

Preferred Apparatus and Method for Coating the Flexible Sheet Material

Figure 2:
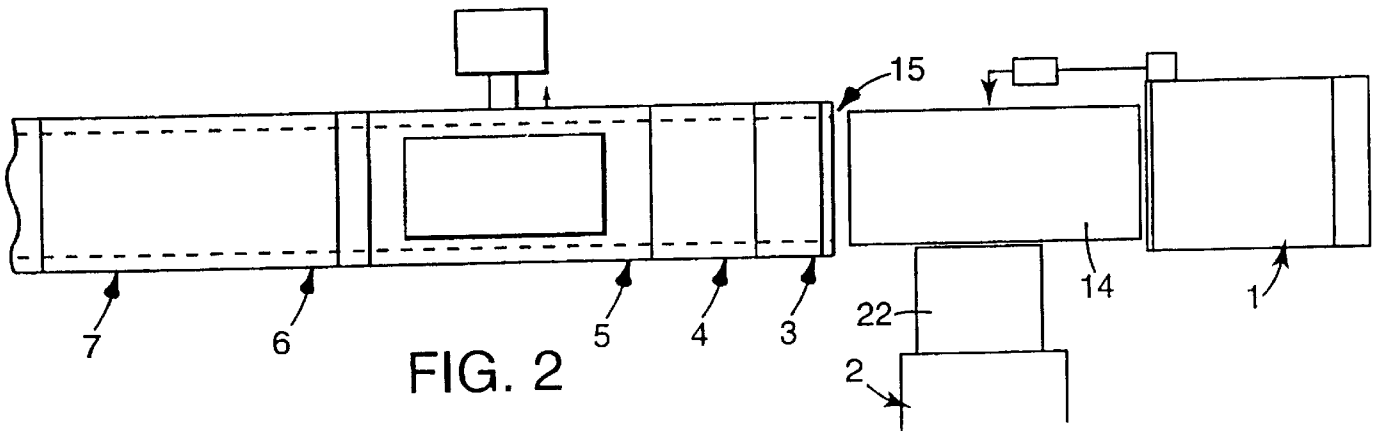
FIG. 2 is a schematic plan view of the apparatus shown in FIG. 1.

The apparatus shown schematically in FIGS. 1 and 2 is specifically for use in the production of repositionable notes from sheets of any suitable substrate material, for example, paper, polymeric film or foils and, in particular, for the application to individual sheets of a primer material, a low adhesion backsize (LAB) material, and a repositionable adhesive so that the sheets can subsequently be used to form repositionable notes. In the following description, it will be assumed, unless otherwise noted, that the sheets (which may be pre-printed) are of paper. The paper may be any suitable paper, such as the paper utilized to construct the Post-it brand repositionable notes available from Minnesota Mining and Manufacturing Company ("3M") of St. Paul, Minn.

The apparatus has a paper path which receives a succession of paper sheets (not shown) from a stack in a sheet feeder 1. From the sheet feeder 1, the sheets travel along the paper path in the direction indicated by the arrow 100 past a sheet inserter 2 (which, as shown in FIG. 2, is located to one side of the paper path) and then through a dual coater 3, a sheet overlapping station 4, a dryer 5, a sheet guiding section 6, and an adhesive coater 7. The control and synchronization of the drives of the various stations may be performed by a central electronic control unit not shown), for example a Siemens PLC 135.

As described in greater detail below, when the inserter 2 is not in use, sheets leave the feeder 1 in a continuous stream in which, to reduce the space required between the feeder 1 and the dual coater 3, the trailing edge of one sheet overlaps the leading edge of the subsequent sheet. The sheets are, however, conveyed separately through the dual coater 3 where they are coated individually on one side with a primer material and on the other side with an LAB material. The sheets emerging from the dual coater 3 are then overlapped once again, in the overlapping station 4, forming a pseudo-web in which the trailing edge of one sheet is overlapped by the leading edge of the subsequent sheet. The pseudo-web is then maintained throughout the remainder of the apparatus although the initial direction of overlap, being undesirable for the dryer 5 and unsuitable for the adhesive coater 7, is reversed when the pseudo-web leaves the overlapping station 4. Following passage through the dryer 5 (in which the primer and LAB coatings are dried), the pseudo-web passes through the guiding section 6 (in which the sheets are side registered and aligned) and the adhesive coater 7 (in which a plurality of adhesive stripes are applied to the sheets, on the side coated with primer material in the dual coater 3). The sheets can then be stacked and trimmed as required to form pads of repositionable notes. As an alternative, the sheets leaving the dryer 5 can be stacked and stored and subsequently re-fed, as a pseudo-web of overlapped sheets, to the adhesive coater.

The inserter 2, which is not an essential part of the apparatus, can be used when it is required to insert one or more sheets from another stack into the stream of sheets entering the dual coater 3. Alternatively, for making a stack of this invention, a stack of uncoated sheets with one or more different sheets inserted therein may be fed from sheet feeder 1. The inserter 2 may be as described in our GB application serial no. 9603345.1 filed 16.02.96 and entitled "Sheet coating method and apparatus with sheet insertion".

Operation of the sheet feeder 1 will now be described in greater detail. The sheet feeder 1 is a rear edge feeder of the type comprising a vertically-movable table 10 on which a stack of sheets 11 is located, and a suction head 12 positioned above the rear edge of the stack. When the feeder 1 is in operation, the suction head 12 lifts the top sheet from the stack 11, by its rear edge, and moves it forwards (assisted by a jet of air from nozzle 12*a*) so that the sheet is taken up by rollers 13 and conveyed out of the feeder and onto a conveyor 14. The suction head 12 then returns and picks up the next sheet which is moved forwards and taken up by the rollers 13 while the first sheet is still present between the rollers. In that way, the trailing end of each sheet overlaps the leading end of the succeeding sheet as the sheets pass between the rollers and are fed onto the conveyor 14. The extent of the overlap depends on the size of the sheets and the relationship between the operation of the suction head 12 and the take-up speed of the rollers 13. As the height of the stack 11 decreases, the table 10 moves upwards to maintain the top of the stack in a predetermined location relative to the suction head 12.

Sheet feeders of the type just described are available from MABEG Maschinenbau GmbH of Offenbach, Germany, under the trade designation "41988". It will be appreciated, however, that any other suitable sheet feeder could be used.

Figure 3:
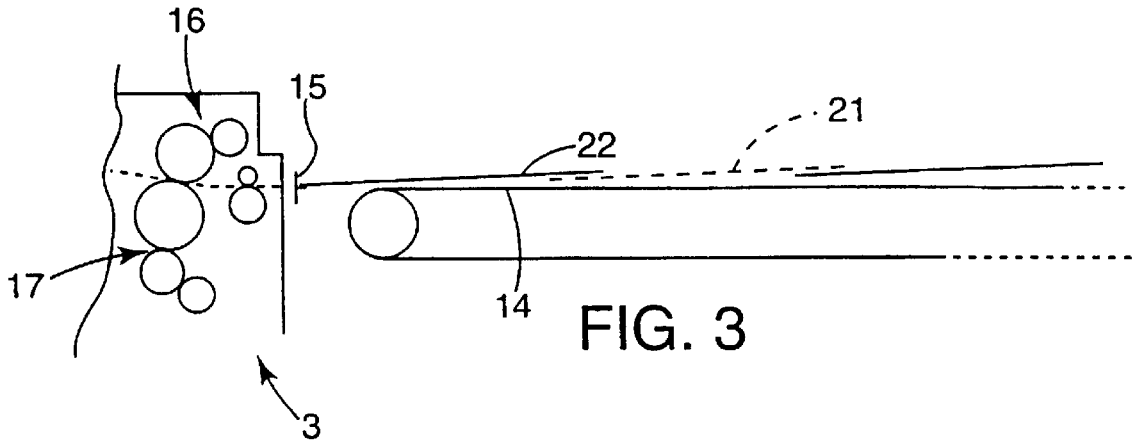
FIG. 3 is a diagrammatic illustration of the relative positions of sheets at the entry to a dual coater forming part of the apparatus shown in FIG. 1.

The sheets from the feeder 1 are carried on the conveyor 14 past the sheet inserter 2 to a gate 15 at the entry to the dual coater 3. For the purposes of the present description, it will be assumed that the sheet inserter 2 is not functioning, in which case the overlapped sheets from the feeder 1 form a continuous stream on the conveyor 14 as illustrated in FIG. 3. As the first sheet 21 arrives at the gate 15, it is temporarily halted while the rollers of upper and lower coating stations 16, 17 (described below) within the dual coater 3 rotate to the correct position for transporting and coating the sheet. The gate 15 then opens to allow the first sheet 21 to enter the dual coater 3, following which the gate closes in advance of the arrival of the second sheet 22 and halts the latter until the rollers of the upper and lower coating stations 16, 17 have again rotated to the correct position.

Figure 4:
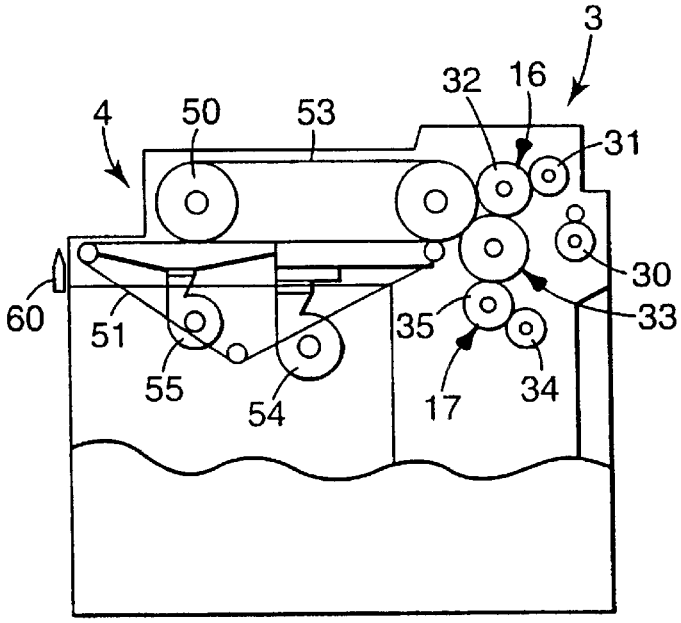
FIG. 4 is a view of a dual coater forming part of the apparatus shown in FIG. 1.

The dual coater 3, which is shown in FIG. 4 and, in greater detail, in FIGS. 5 and 6, will now be described. The sheets from the conveyor 14 are picked up by a nip roll pair 30 within the dual coater 3 and fed between the upper coating station 16 and lower coating station 17 (already mentioned) which are located, respectively, above and below the paper path through the dual coater. As the sheets pass through the dual coater the upper station 16 applies a coating of primer material to one side of each sheet and the lower station 17 simultaneously applies a coating of LAB material to the other side of each sheet. The sheets are fed into the dual coater 3 in a non-overlapped condition. This exposes all, or a substantial portion, of both major surfaces of the sheets to coating by the LAB and the primer. As described below, mechanical means are used to grip and advance the sheets through the dual coater allowing the primer material and the LAB material to be coated over substantially the entire major surfaces of the sheets.

The upper coating station 16 comprises a metering roller 31 and a coating roller 32, located above the path of the sheets of paper through the dual coater. The coating roller 32 cooperates with a coating drum 33 of the lower coating station 17 which also comprises a metering roller 34 and a transfer roller 35, all located below the paper path through the dual coater. The coating drum 33 has a cut-out portion 36 of rectangular cross-section (shown in greater detail in FIG. 7) which contains a conventional sheet gripper 37 (shown closed in FIG. 7) for grasping sheets from the feed nip 30, In addition, the drum is covered, around less than half its circumference, with a blanket 38 (not shown in FIG. 4) whereby, as described below, the coating roller 32 and coating drum 33 form a coating nip only when the blanket is located directly adjacent the coating roller 32. As described below, the upper coating station 16 provides substantially full surface roll coating of primer material on the upper surface of the sheets, and the lower coating station 17 provides substantially full surface roll coating of LAB material on the lower surface of the sheets. In each case, the portions engaged with the grippers (as described herein) are not coated.

In the upper coating station, a trough 39 for the printer material is formed by the surfaces of the metering and coating rollers 31, 32 adjacent the nip between the rollers and on the upper side thereof together with two opposed end walls (not shown) which engage in grooves (not shown) adjacent the ends of the rollers. As the rollers 31, 32 rotate, the primer material forms a film on the coating roller 32 and is transferred to a sheet passing underneath the roller.

The thickness of the primer film on the coating roller 32, and hence the amount of primer coated onto a sheet, is dependent on the viscosity of the primer and on the pressure between the metering and coating rollers 31, 32 and, for a given primer, can be adjusted by moving the metering roller towards or away from the coating roller and by adjusting its speed. The trough 39 is supplied with primer by nozzles 40 (see also FIG. 6) which receive the primer from a tank 41 by means of a pump 42. The trough 39 also has overflow outlets 43 through which excess primer is returned to the tank.

In the lower coating station 17, a trough 44 for LAB material is similarly formed between the metering roller 34 and the transfer roller 35. As in the upper station, the coating material forms a film on the transfer roller, the thickness of which can be adjusted by moving the metering roller 34 towards or away from the transfer roller 35 and by adjusting its speed, thereby controlling the amount of LAB material that passes from the transfer roller to the blanket covering 38 on the coating drum 33 (but not on to the remainder of the drum, which the transfer roller 35 does not contact).

In a similar manner to the trough 39 in the upper coating station 16, the trough 44 is supplied with LAB material by respective nozzles 45 (see also FIG. 6) which receive the LAB material from a respective tank 46 by means of a pump 47. The trough 44 has overflow outlets 48 through which excess LAB material is returned to the tank 46. As the blanket-covered part of the drum 33 moves around adjacent the coating roller 32 of the upper station, a sheet that is incoming from the feed nip 30 of the dual coater 3 will be picked-up by the gripper 37 in the drum and carried through the coating nip between the roller 32 and the blanket 38 on the drum 33 and, as the sheet passes through the nip, it will be coated on one side with the LAB material. Sheet strippers (not shown) are located on the downstream sides of the coating roller and the coating drum to ensure that sheets do not wrap around either the roller or the drum but are fed out to the overlapping station 4. The next sheet from the feed roll nip 30 will be picked up and carried between the coating roller 32 and the coating drum 33 when the blanket covering once again moves around adjacent the roller 32, operation of the gate 15 being timed to ensure that a sheet is picked up on every rotation of the drum. In the event that no sheet is waiting at the gate 15 (as a result, for example, of a mis-feed at the feeder 1 or the inserter 2), that fact is detected by a photocell (not shown) at the gate, and the roller 32 is moved away from the drum 33 to prevent any mixing of the primer and LAB materials.

It will be appreciated that the coating in the dual coater 3 is discontinuous because it occurs only when the blanket covering 38 on the coating drum 33 is adjacent the coating roller 32 (i.e. when a sheet is passing through the coating nip). A typical coating weight for the LAB material on the sheets is from about 0.5 gsm to about 12.0 gsm and the coating weight of the primer material would be matched to that to ensure that the coated sheets remain flat. Because the primer and the LAB materials are applied to the paper sheets simultaneously in the coating station and are preferably selected to have appropriately selected characteristics, such as viscosity, % solids, and coating weights, the risk that the sheets will curl or wrinkle is substantially eliminated. As an alternative, a dual coater which does not apply the primer and LAB coatings simultaneously could be used although with a loss of benefits associated with simultaneous coating. For example, the primer coating station 16 could be located prior to the LAB coating station 17, in which case the coating roller 32 and the coating drum 33 would each require respective counterpressure roller.

The blanket covering 38 on the coating drum 33 can be of any suitable type, but is preferably formed from a rubber or any other suitable elastomeric material. The blanket 38 is secured by adhesive to a sheet of support material 38A which is capable of being wrapped around and releasably-secured to the drum 33. The support sheet 38A may, for example, be a plastics material such as that available under the trade designation "Mylar", and the blanket 38 may be secured to the support sheet by a neoprene glue such as that available, under the trade designation "1236", from Minnesota Mining and Manufacturing Company of St. Paul, Minn., U.S.A. The support sheet 38A is releasably secured to the drum 33, for example by screws. In that way, the blanket 38 can be easily removed from the drum and replaced when necessary. If the blanket 38 is secured to the support sheet 38A while the latter is laid out flat, it is preferred that a flexible adhesive should be used to secure the blanket. The flexibility of the adhesive is less important if the blanket 38 is secured to the support sheet after the latter has been attached to the drum 33. Any suitable adhesive can be used to secure the elastomeric blanket 38 to the support sheet provided, in particular, that it will ensure that the comers of the blanket do not lift away from the support sheet during the coating process.

Figure 7:
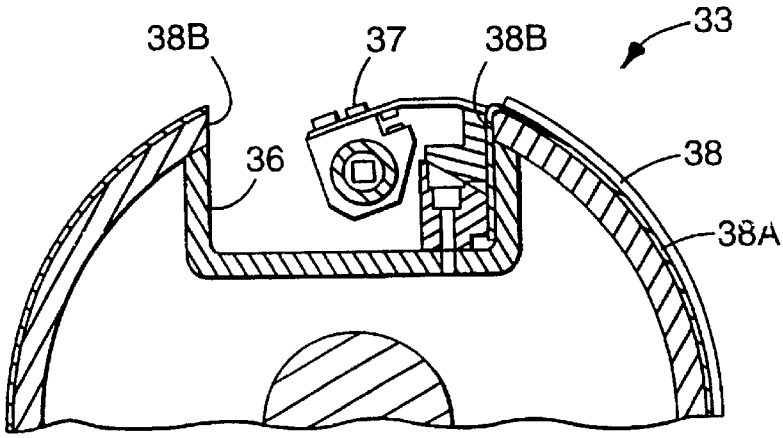
FIG. 7 is an enlarged view of part of FIG. 5.

A coating drum as shown in FIG. 7 is also described in our GB application serial no. 9603366.7 filed Feb. 16, 1996 and entitled "Sheet coating apparatus including a coating roller".

As an alternative, the blanket covering 38 on the coating drum 33 may be a DuPont "CYRELL" polyurethane blanket available from E.I. DuPont de Nemours of Wilmington, Del., U.S.A.

Figure 5:
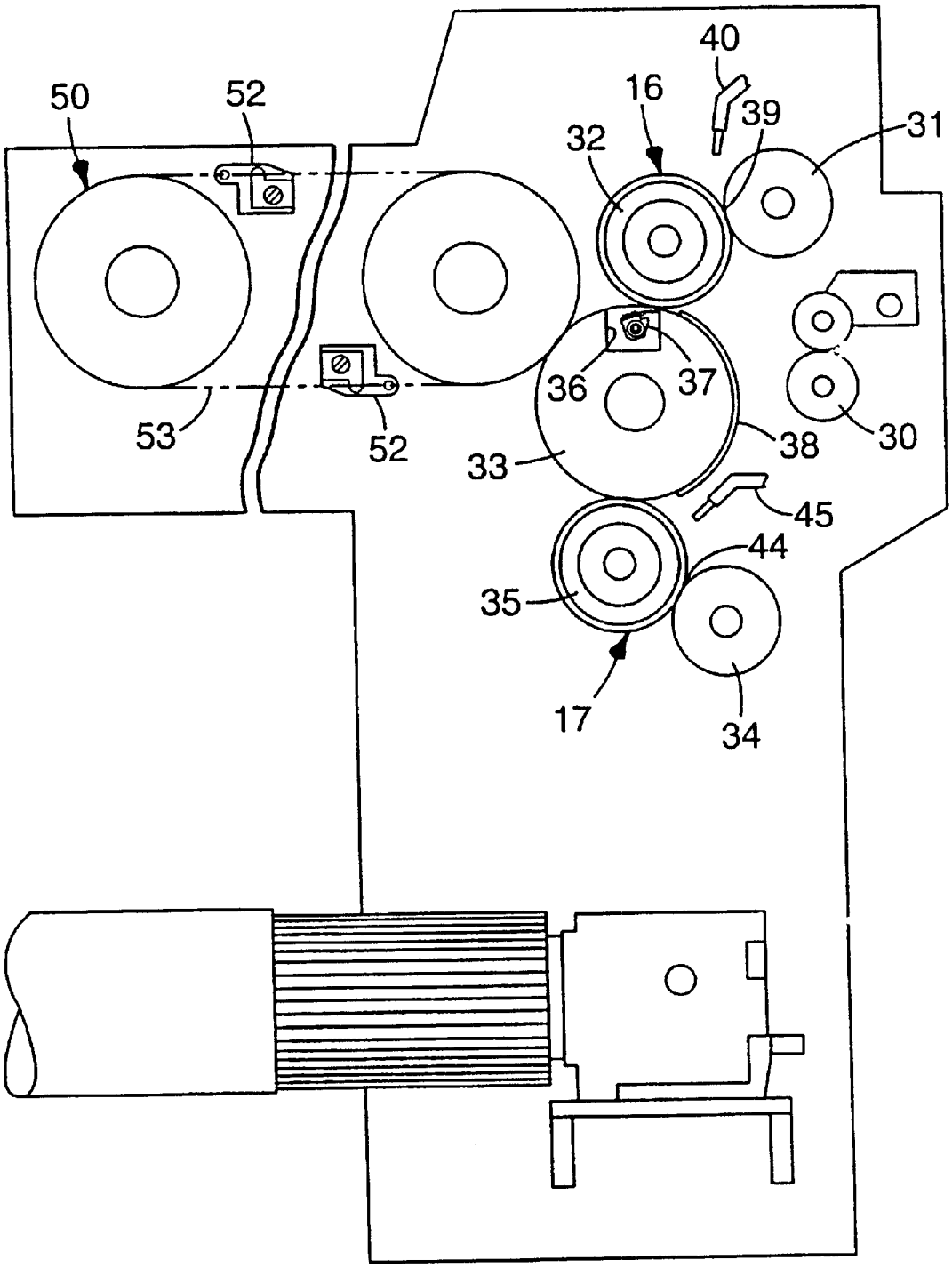
FIG. 5 is a view similar to FIG. 4 showing part of the dual coater in greater detail.
Figure 6:
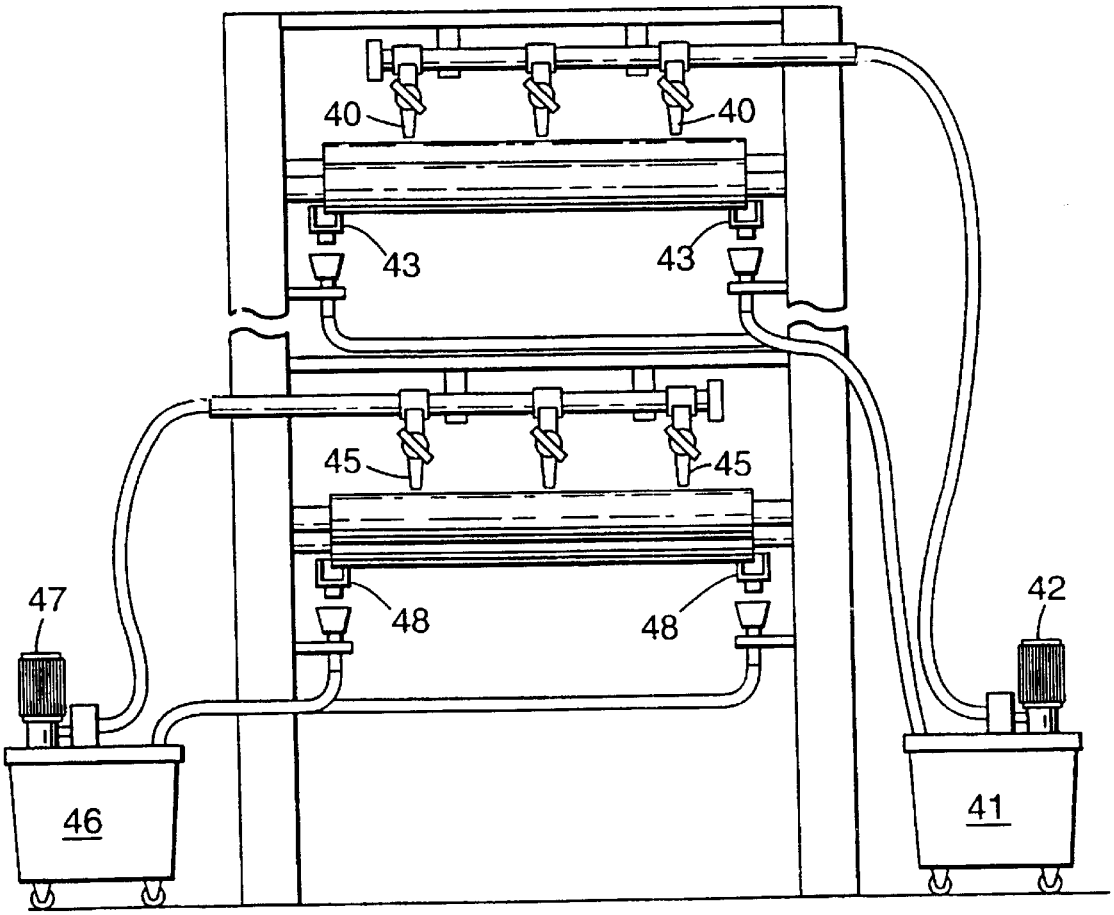
FIG. 6 shows a coating material supply system for the dual coater of FIGS. 4 and 5.

On the exit side of the coating nip 32, 33, is the sheet overlapping station 4 in which a gripper unit 50 is positioned to take sheets as they emerge from the coating nip and deposit them on a conveyor 51 (not shown in FIG. 5). The gripper unit 50, which is conventional, comprises sheet grippers 52.carried on an endless chain 53 the movement of which is synchronized with the sheet feed so that a gripper 52 is positioned to receive each sheet that leaves the coating nip. A blower 54, located below the paper path on the exit side of the coating nip, provides a cushion of air to support the sheets as they are being carried by the sheet grippers 52. The blower 54 incorporates a heater (not shown) which serves to dry the LAB coating on the sheet to some extent, to prevent the sheets from sticking to the conveyor. The conveyor 51 is run at a slower speed than the chain 53 of the gripper unit so that each sheet is deposited on the conveyor with the leading edge of the sheet lying on top of the trailing edge of the preceding sheet, forming a pseudo-web of sheets. Typically (but not essentially), the extent of the overlap is from about 1 centimeter (cm) to about 2 cm. The conveyor 51 is a vacuum conveyor connected to a source 55 of low pressure so that the sheets are positively held on the conveyor and the overlapped relationship between them is maintained.

The dual coater 3 together with the sheet overlapping station 4 may be based on the "GULLA SPEED GS GS 8000" coater available from Bilhofer Maschinenfabrik GmbH of Nürnberg, Germany.

From the output end of the conveyor 51, the sheets move to a further vacuum conveyor 56 (FIG. 1) which carries the sheets through the dryer 5 (described in greater detail below). Between the conveyors 51, 56, the sheets pass through an arrangement which reverses the direction in which the sheets are overlapped. That arrangement, which includes a blower 60 shown in FIG. 4, is illustrated diagrammatically in FIGS. 8 and 9. In addition to the blower 60 (which is located between the conveyors 51, 56 and below the paper path) the arrangement includes a stationary vacuum cylinder 61 with closed ends 62 which is located above the paper path and slightly downstream of the blower. The portion of the vacuum cylinder 61 directed towards the blower 60 is formed with a plurality of apertures 63, shown in FIG. 9, the remainder of the cylinder being closed. In use, the interior of the cylinder is connected by a line 67, through one of the closed ends 62, to a source of vacuum 66. Typically, the cylinder 61 has a diameter of about 15 cm and the apertures 63 (of which there are three rows, spaced at 30 mm) have a diameter of 6 mm and are spaced at 30 mm within the rows.

The arrangement shown in FIG. 8 functions as follows. Operation of the blower 60 is timed so that a discrete jet of air is directed at the overlap between each pair of successive sheets 64, 65 (i.e. when a sheet 64 has begun to move onto the conveyor 56 and the sheet 65 has begun to move off the conveyor 51), causing the trailing end of the sheet 64 and the leading end of the sheet 65 to lift up as shown in dotted lines in FIG. 8. The trailing end of the sheet 64 will then come under the influence of the vacuum within the cylinder 61, acting through the apertures 63, and will be pulled towards the cylinder where it will be held while the leading end of the sheet 65 falls back onto the paper path. The sheet 65 now continues to move forwards onto the conveyor 56 which, at the same time, pulls the trailing end of the sheet 64 away from the cylinder 61 and back onto the paper path although now located above, rather than below, the leading end of the sheet 65.

It will be appreciated that, because the vacuum within the cylinder 61 does not influence the sheets while they are lying flat on the conveyors 51, 56, the vacuum can be applied constantly. The vacuum should be applied at a level sufficient to ensure that it can attract and hold the trailing end of a sheet (such as sheet 64 in FIG. 9) but not so great that the sheet cannot be removed by the forwards movement of the conveyor 56. If desired, a plate 68 can be located above the cylinder 61 and the blower 60, for example as shown in FIG. 8, to direct the jet of air from the blower towards the cylinder.

Figure 8:
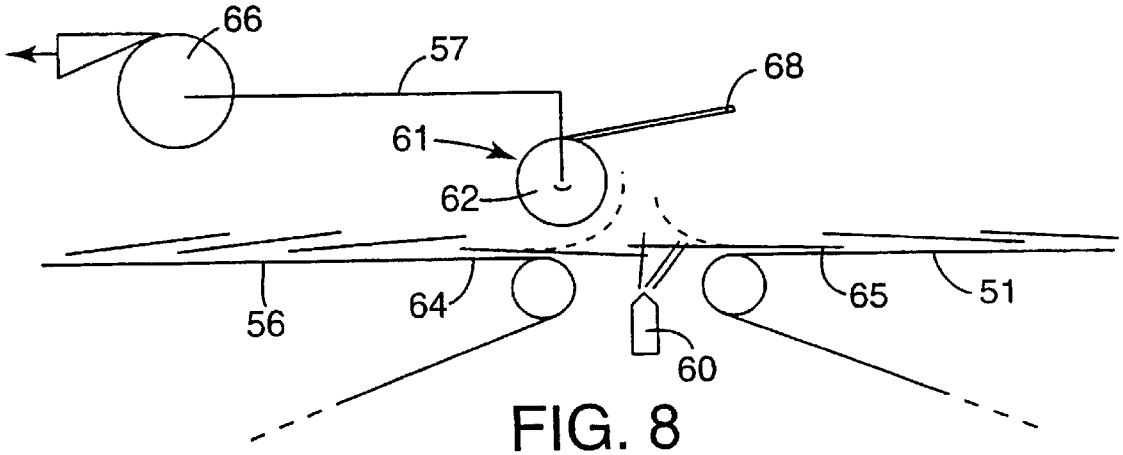
FIG. 8 is an enlarged diagrammatic view illustrating a part of the apparatus shown in FIG. 1.
Figure 9:
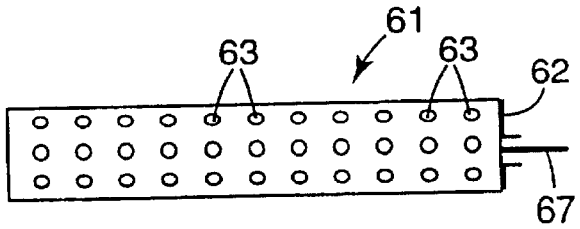
FIG. 9 shows a component of FIG. 8.

Any other suitable arrangement could be used for changing the direction of overlap of the sheets between the conveyors 51 and 56 including, for example, an air knife alone or an equivalent mechanical arrangement, for example similar to that described in GB-A-2 166 717 but with a loss of benefits associated with the arrangement of FIG. 8.

Returning to FIG. 1, the pseudo-web of sheets now moves out of the sheet overlapping station 4 and into the dryer 5 in which moisture is removed from the primer and LAB coatings. The dryer 5 is preferably a radio-frequency dryer, for example a particularly adapted version of the Model No. SP 890 GF"C"-AG manufactured by Proctor Strayfield Ltd. of Berkshire, England. The dryer 5 is provided with a control unit (not shown) which adjusts the power of the dryer in accordance with the line speed of the apparatus. That control unit may, for example, be a Siemens PLC 55 95U interconnected with the central electronic control unit of the whole apparatus. The overlapped sheets move through the dryer 5 continuously on the endless belt 56 and are dried at a rate which attenuates the tendency of the sheets to curl but which ensures that they emerge substantially dry. The use of a radio-frequency dryer is not essential and the overlapped sheets could, instead, be dried using infra-red heating or hot air. Alternatively, the endless belt 56 could be heated to dry the sheets. However, radio-frequency drying is preferred for its simplicity and lower energy consumption.

Although it is preferable to change the direction of sheet overlap before the sheets enter the dryer 5 (as described above) because it is then less likely that the sheets will lift away from the belt 56, it is possible to defer that operation until the sheets have been dried. In that case, the apparatus shown in FIG. 8 would be located at the outlet of the dryer 5.

Figure 10B:
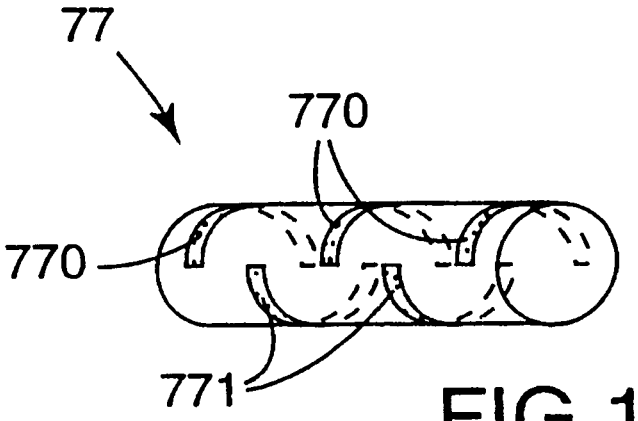
FIG. 10*b* is a diagrammatic view of a gravure roller for use in the adhesive coater shown in FIG. 10*a;*

Downstream of the dryer 5, the overlapped sheets move through the guiding section 6 in which they are side registered and aligned with each other in preparation for advancement to the adhesive coater 7. In the adhesive coater 7, the overlapped sheets pass through a transfer station 70 (see also FIG. 10*a*) where they contact an endless transfer belt 71 to which an adhesive coating has previously been applied in the form of spots or a plurality of stripes extending longitudinally of the belt.

The transfer belt 71 is trained around rollers 72, at least one of which is driven so that the belt advances in the direction of the arrow 73. As the transfer belt 71 moves (at the same rate of advance as the overlapped sheets), it passes a coating mechanism 74, a dryer 75 and the transfer station 70, each of which will be described in greater detail below. Preferably, the adhesive is dried at least partially (i.e. the moisture content is reduced to a desired level), in the dryer 75, before being transferred to the overlapped sheets at the transfer station 70. For instance, the moisture content of the water-based adhesive may be approximately 50%–80% prior to drying and 0%–50% after drying. Preferably, substantially all of the moisture is removed during the drying process.

The coating mechanism 74 applies repositionable adhesive to the transfer surface 76 of the transfer belt 71. The coating mechanism may, for example, use a rotating gravure roller 77 to apply the adhesive. The gravure roller 77 (FIG. 10*a*, 10*b*) contacts, and extends across the width of, the transfer belt 71 and has at least a first (770) and a second (771) gravures formed in its surface. The first 770 and second 771 gravures extend around only part of the circumference of the gravure roller 77 and they are radially and axially offset relative to each other such that at desired locations repositionable adhesive is applied on the transfer belt. The gravures 770, 771 are preferably in the form of a band in which the repositionable adhesive is applied in the form of stripes of adhesive or the gravure can be in the form of a circle or ellipse so that a spot of repositionable adhesive is applied.

Figure 10C:
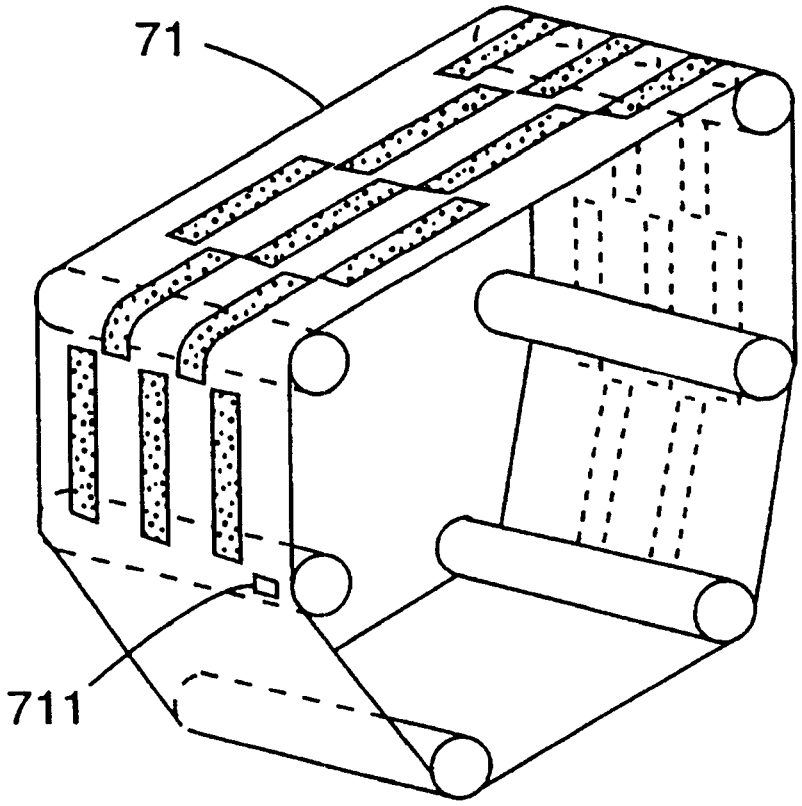
FIG. 10*c* is a diagrammatic representation of an endless transfer coated with adhesive stripes using the gravure roller shown in FIG. 10*b;*
Figure 12:
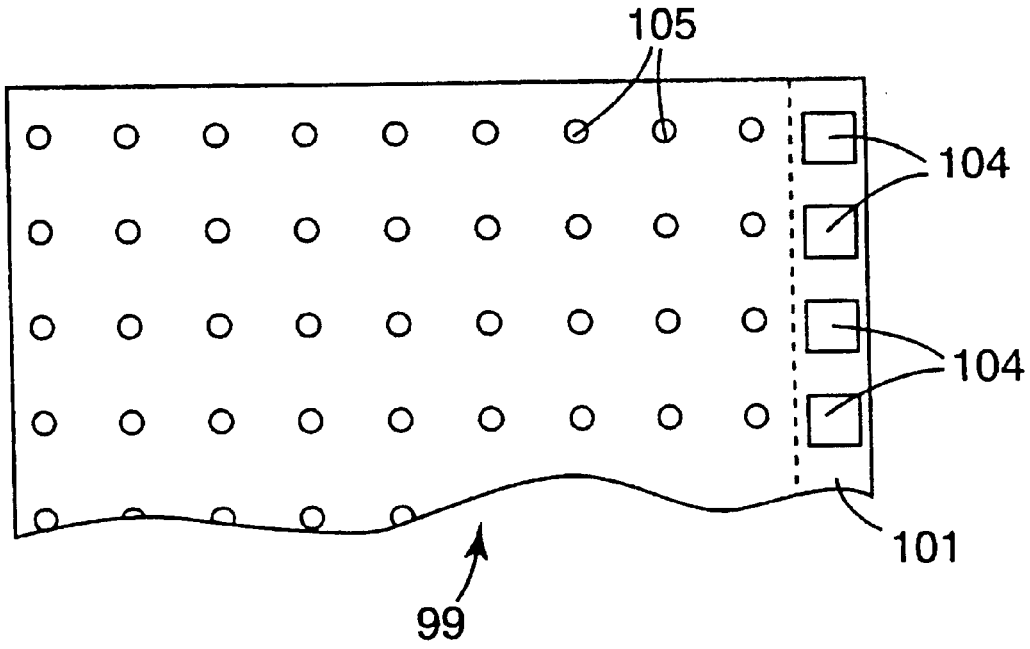
FIG. 12 is a partial plan view of a component of FIG. 11.

Preferably, the transfer belt 71 also includes a synchronisation means 711 such that the coating of the repositionable adhesive on the transfer belt 71 can be started at a predefined position (see FIG. 10*c*). For example, transfer belt 71 may have a marking for example in the form of a vertical stripe extending across the transfer belt 71 or a marking area, for example a square along one edge. Such marking can then be used to position the gravure roller 77 at this part of the transfer belt 71 such that the gravure roller 77 is contacted with the transfer belt 71 between the first 770 and second 771 gravures when coating to the transfer belt is started. To aid in correctly positioning the gravure rolled 77 relative to the synchronisation means 711 on the transfer belt, the gravure roller 77 may also include a synchronisation means (not shown) for example in the form of a mark. Positioning the gravure roller 77 at the start of coating then results in a coating on the transfer belt 71 as illustrated in FIG. 10*c*.

As shown in FIG. 10*c*, when the gravure roller 77 is contacted (not shown) between the first 770 and second 771 gravure bands at the synchronisation means 711 on the transfer belt 71 and then makes a half turn while maintaining contact between the gravure roller 77 and the transfer belt 71, adhesive is applied from first gravure bands 770 to the transfer belt 71. Turning the gravure roller 77 further while in contact with the transfer belt 71 to complete a full turn, will apply repositionable adhesive from second gravure bands 771 to the transfer belt. Because first 770 and second 771 gravure bands only extend around part of the circumference of the gravure roller and are radially and axially offset relative to each other, the adhesive coatings from first 770 and second 771 gravure bands resulting on the transfer belt 71 are transversally offset and are discontinuous.

Preferably, the length of the discontinuity in the adhesive stripes corresponds to at least the length of the sheets in their direction of conveyance. Accordingly, if the start of a sheet is synchronised with the start of an adhesive stripe, adhesive stripes resulting from first 770 and second 771 gravures will be applied alternatingly to the sheets.

Synchronisation of the start of a sheet with the start of adhesive stripes may be accomplished by detecting the position of the transfer belt 71 and the start of a sheet. This can for example be done by a contrast cell detecting the synchronisation means 711 on the transfer belt 71 and by having a black stripe at the start of each sheet which might also be detected by a contrast cell. The detection of the position of the transfer belt 71 and start of a sheet may then be used to adjust the speed of the transfer belt 71 and/or speed of conveyance of the sheets to obtain proper synchronisation.

The adhesive which is to be applied to the transfer belt 71 by the gravure roller 77 is supplied by a pump 78 from a tank 79 to a trough 80 at the coating mechanism 74. A metering roller 81 dips into the adhesive in the trough and, as it rotates, the metering roller picks up adhesive which it then transfers to the reverse rotating gravure roller 77 and in particular, to the gravures. One or more doctor blades (such as at 82) engage the gravure roller 77 to remove any excess adhesive and ensure that all the adhesive on the gravure roller is contained only within the cells of the gravures, thereby ensuring that the adhesive will be transferred in stripes or spots to the transfer belt 71.

The transfer belt 71 with the adhesive stripes then passes through the dryer 75 (FIG. 1) in which the adhesive stripes are dried at least partially (i.e. ranging from 0%–50%). This is done to improve the adherence of the adhesive to the sheets. The dryer 75 is preferably a radio-frequency dryer, for example a particularly adapted version of the Model No. SPW 12-73 manufactured by Proctor Strayfield Ltd. of Berkshire, England operated, typically, at about 27 MMz or alternatively, at about 30 MHz. The dryer is about 2.5 m long in the direction of travel of the belt and has an exhaust (not shown) through which the interior of the dryer is vented with the aid of a fan 84. The dryer is provided with a control unit (not shown) which adjusts the power of the dryer in accordance with the line speed of the coating apparatus. That control unit may, for example, be a Siemens PLC 55-95U interconnected with the central electronic control unit of the whole apparatus.

A radio-frequency dryer requires that the material of the transfer belt 71 be non-reactive (i.e. transparent or otherwise not affected by the radio frequency radiation to a degree that adversely affects the operation of the method and apparatus of the present invention) to radio frequency radiation. This arrangement offers the advantage that the adhesive is dried without the transfer belt being significantly heated, thereby eliminating any heat transfer from the belt to the coating mechanism 74 and then to the adhesive which could cause the adhesive to coagulate before it has been applied to the transfer belt 71. A radio-frequency dryer also offers the advantages of comparative simplicity and lower energy consumption. Further, the transfer belt 71 requires no prolonged pre-heating to a particular operating temperature and the adhesive is released readily from the belt for transfer to the sheets at the coating station.

Preferably, the transfer belt 71 comprises a fibre glass fabric base layer, approximately 0.1 mm thick, coated on each side with a layer of silicone rubber approximately 0.15 mm thick.

However, it will be understood that other forms of transfer belt can be used that are incompatible with a radio frequency dryer (i.e. are not transparent or inert to radio frequency radiation) although with a loss of benefits associated with a belt that is non-reactive. For example, the transfer belt may comprise a metal substrate with a coating of silicone rubber on each side. Other types of dryers that may be employed include, for example, an infra-red heater, or a hot air dryer. However, if the dryer causes the transfer belt 71 (and then the coating mechanism 74) to become heated it may be necessary to cool the adhesive and the transfer belt to reduce the risk of the adhesive coagulating.

At the transfer station 70, the adhesive-coated transfer belt 71 passes through a transfer nip 85 comprising a transfer roller 90 and an idler counter pressure roller 91. The overlapped sheets 86 from the guiding section 6 of the apparatus are also directed through the transfer nip 85, as already mentioned, and are supported by the counter-pressure roller 91 against the transfer roller 90 and consequently against the transfer belt 71 so that adhesive is transferred from the belt to the sheets.

The counter-pressure roller 91 at the transfer nip 85 is provided with a plurality of spaced circumferential grooves 92 (FIG. 11), and a plurality of fingers 93 are provided immediately downstream of the roller 90 to engage in those grooves. The fingers 93 ensure that the overlapped sheets 86 continue to travel with transfer belt 71 after the sheets have left the transfer nip 85 and do not wrap around the counter-pressure roller 91. The sheets 86 are removed from the transfer belt 71, downstream of the fingers 93, by a detachment conveyor in the form of a vacuum belt 95 which, as described below, also serves to transport the sheets to the paper path exit 96 of the apparatus (FIG. 10*a*). The removal of the sheets from the transfer belt 71 is facilitated by the direction in which the sheets overlap (i.e. by the fact that the leading edge of each sheet is overlapped by the trailing edge of the preceding sheet).

An additional roller 97 is provided to engage the inside of the transfer belt 71 downstream of the beginning of the vacuum belt 95 and is positioned to ensure that the transfer belt is initially (i.e. prior to the roller 97) inclined at a small angle (of about 1 to 3 degrees) to the vacuum belt and then (i.e. after the roller 97) at a much greater angle (of about 3 to 6 degrees). Typically, the angle at which the transfer belt 71 is inclined to the vacuum belt 95 is initially about two or three degrees for a distance of about 50 mm while the vacuum belt functions to remove sheets from the transfer belt, and then increases to about five degrees to increase the separation between the transfer belt and the sheets. The roller 97 is movable, as indicated by the arrow 97*a*, to enable the angles between the transfer belt 71 and the vacuum belt 95 to be adjusted.

Figure 13:
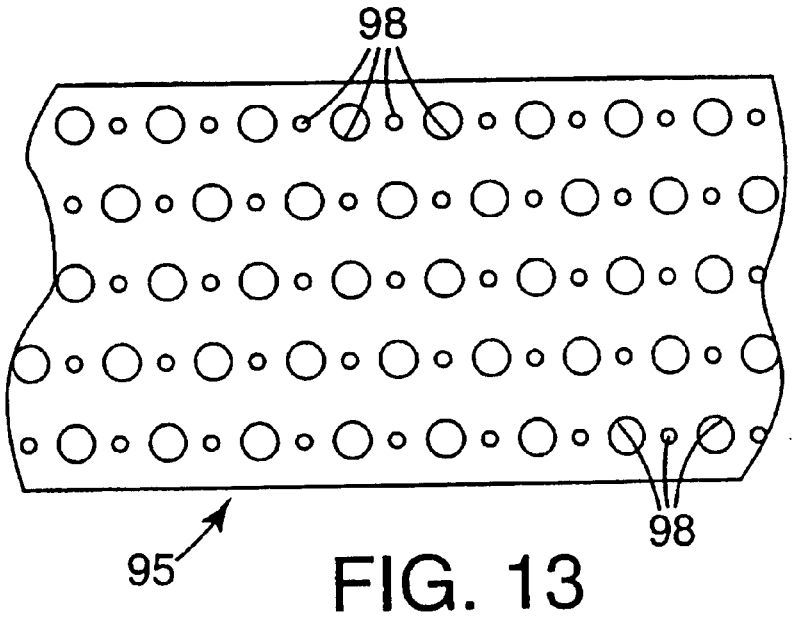
FIG. 13 is a partial plan view of another component of FIG. 11.

The vacuum belt 95 is connected to a source of low pressure in vacuum box 99 and is apertured as indicated at 98 in FIG. 13, so that reduced pressure is applied through the belt to sheets on the surface of the belt. The reduced pressure applied through the vacuum belt 95 is comparatively strong over the initial part of the run of the belt, where the relative inclination of the transfer belt 71 is smallest, and then decreases when the relative inclination of the transfer belt increases. To that end, a compartment 101 is formed within the vacuum box 99 and is connected, through port 102, to a source of comparatively strongly-reduced pressure while the remainder of the vacuum box is connected, through ports 103, to a source of more moderately-reduced pressure. In addition, the reduced pressure in compartment 101 is applied to the belt 95 through comparatively large openings 104 in the surface of the vacuum box 99 while the reduced pressure in the remainder of the vacuum box is applied through more restricted openings 105. The reduced pressure applied through the openings 104 is sufficiently high to detach the sheets from the transfer belt 71 without damaging them and it then decreases over the remainder of the vacuum box 99 to a level sufficient to maintain the detached sheets on the vacuum belt, again without damaging them (in this case, for example, by being marked by the apertures 98) so that they can be transported to the paper path outlet 96. For example, a reduced pressure in the range of from 350 to 550 mm $H_2O$ (typically 400 mm $H_2O$) may be applied over the initial part of the run of the belt 75, with a reduced pressure in the range of from 150 to 200 mm $H_2O$ being applied over the remainder of the run. In each case, the degree of reduced pressure that can be applied is limited by the need to avoid damage to the sheets and will vary depending on the nature of the sheet material. Once detached from the vacuum belt 95, the sheets may be stacked and trimmed to form pads of repositionable notes, for example those available under the trademark "Post-it" available from the Minnesota Mining and Manufacturing Company ("3M") of St. Paul, Minn. The vacuum belt 95 need not be a single belt that extends over the width of the In vacuum box 99 but could comprise a plurality of narrower belts arranged side-by-side.

Figure 14A:
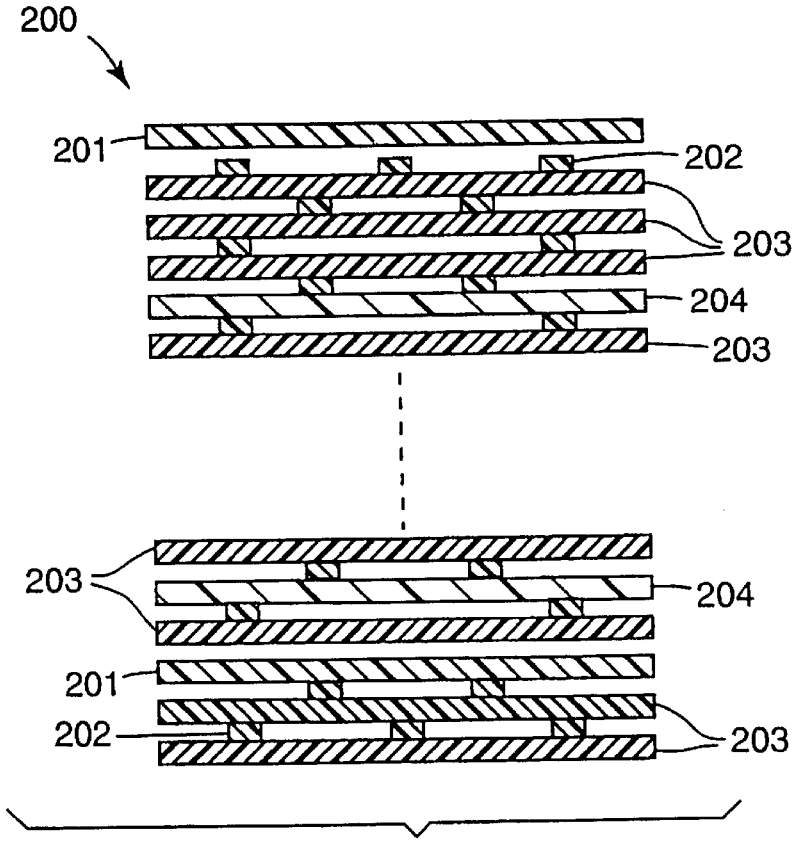
FIGS. 14*a* to 14*c* schematically depict trimming of a stack of sheets in pads of desired size and shape.
Figure 14B:
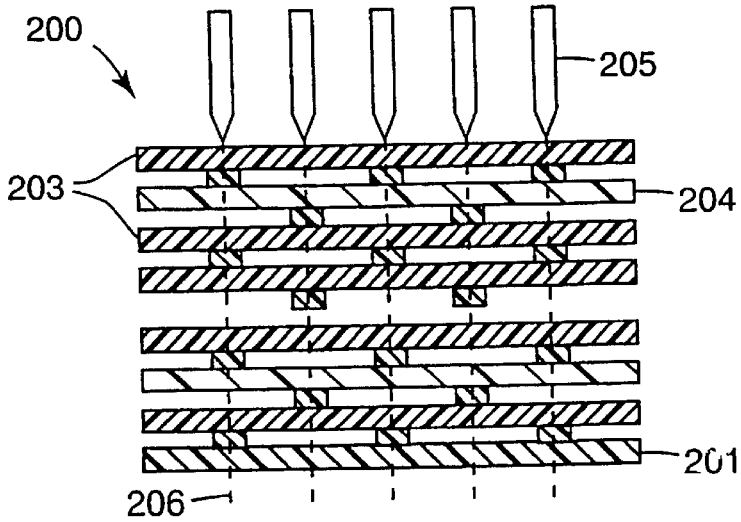
Figure 14C:
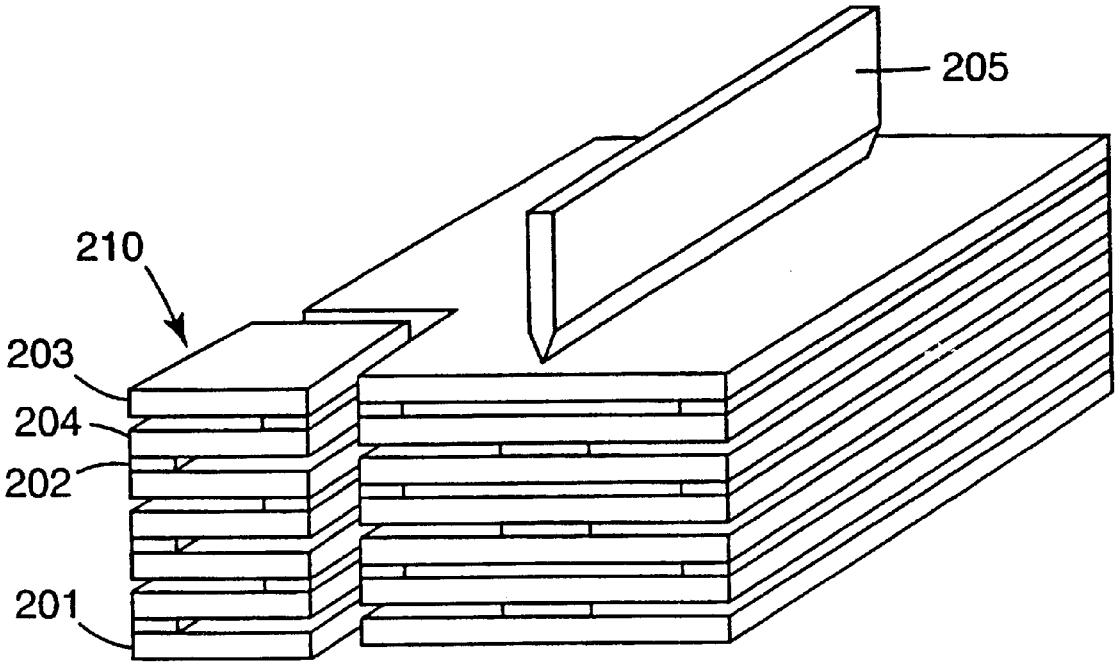

FIGS. 14*a* to 14*c* schematically illustrate the trimming process. Thus, a stack of sheets 200 from a coating apparatus shown in FIG. 1 will typically comprise backing sheets 201, first sheets 203 and second sheets 204 different from the first sheets 203 with repositional adhesive 202 coated to the back of sheets 203 and 204. As shown in FIG. 14*b*, the stack 200 is then cut by means of knifes 205 along lines 206 such that individual stacks result wherein the repositionable adhesive alternates between two opposite edges of the stack. A thus resulting stack may then be further trimmed along a direction perpendicular thereto to obtain a desired size and shape of the stack (FIG. 14*c*).

Although the above description refers to the sheets as being paper, they could (as already mentioned) be formed of other materials, for example polymeric films as previously described. When the sheets are paper, they are preferably fed through the apparatus with the "machine direction" of the paper sheets aligned with the machine process direction; in that way, the tendency of the sheets to curl or wrinkle can be farther attenuated.

Papers of different weights and textures can be used if desired. For example, the described apparatus is readily adaptable to handle for example, sheets of A4 size or sheets of A2 size. Likewise, the apparatus is able to handle sheets of a comparatively high weight (e.g. 250 gsm) and also sheets of a lower weight (e.g. 80 gsm).

If the sheets supplied to the dual coater 3 are pre-printed, the above-described method results in the LAB coating material being applied over the printed matter on the sheets. The LAB coating then serves to protect the printed matter, especially against removal by the adhesive on an adjacent sheet when the sheets are subsequently stacked and cut to form pads of repositionable notes. The protection offered by the LAB coating enables the use of stronger adhesives on printed notes to be considered. Of course, printed matter may also be applied to the sheets after the dual coater 3, whether or not pre-printed, using any conventional printing operation.

Although the sheet removal arrangement of FIG. 10*a* has been described above as forming part of an adhesive coater, it will be appreciated that it could be used in other circumstances when it is required to apply a coating material to sheets using an endless-transfer.

It will also be appreciated that various modifications may be made to the overall configuration of the apparatus shown in FIG. 1 without affecting the operation of the adhesive coater 7 (and, in particular, the sheet removal arrangement). For example, the overlapping station 4 could be omitted and the sheets could be fed directly from the dual coater 3 to the dryer. In that case, the sheets can be overlapped just before they are fed into the adhesive coater 7. Such an arrangement is described in our GB application Serial no. 9603281.8 filed Feb. 16, 1996 and entitled "Method and apparatus for coating sheets on both sides with waterbased material", which also describes how sheets from the dryer may be collected and stacked and subsequently re-fed, as a pseudo-web of overlapped sheets to the adhesive coater.

Furthermore, although desirable, it is not essential for sheets to be fed into the dual coater 3 in a non-overlapped condition. They could, for example, be fed into and through the dual coater as a pseudo-web of overlapped sheets as described in the above identified WO 94/19419. In that case, the sheet overlapping station 4 of FIG. 1 (including the apparatus of FIG. 8 for changing the direction of overlap) is not required.

What is claimed is:

1. Apparatus for applying repositionable adhesive to a plurality of sheets, the apparatus including a conveyor arrangement for conveying a plurality of sheets in overlapped end-to-end relationship to a transfer location;

an endless transfer surface which is movable through the transfer location in contact with the conveyed sheets;

and a coating means arranged to apply, to the endless transfer surface, repositionable adhesive for subsequent transfer to sheets to form coated areas thereon at the transfer location;

wherein said coating means is capable of applying repositionable adhesive to said endless transfer surface in such a way that when repositionable adhesive is transferred to a first and second sheet that are next to each other, the coated areas on said first and second sheets are offset relative to each other in the direction perpendicular to the direction of conveyance of the sheets.

2. An apparatus according to claim 1 wherein said coating means comprises a gravure roller having a first and second gravure extending around part of the circumference of the gravure roller and said first and second gravure being radially and axially offset relative to each other.

3. An apparatus according to claim 3 wherein said first and/or second gravure are in the form of a band, circle or ellipse.

4. An apparatus according to claim 1 wherein said endless transfer surface comprises synchronisation means.

5. An apparatus according to claim 1 wherein said apparatus further includes:

a detachment conveyor located adjacent the path of the sheets leaving the transfer station; and a source of reduced pressure operable to apply, over a first part of the length of the detachment conveyor closest to the transfer station, a reduced pressure at a first level sufficient to detach the sheets from the transfer surface and attract the sheets to the detachment conveyor and, over a second part of the length of the belt, a reduced pressure at a second level sufficient to maintain the sheets on the detachment conveyor to be carried away from the transfer station.

* * * * *

UNITED STATES PATENT AND TRADEMARK OFFICE

CERTIFICATE OF CORRECTION

PATENT NO. : 6,406,244 B1
DATED : June 18, 2002
INVENTOR(S) : Leriche, Frederic P. A.

It is certified that error appears in the above-identified patent and that said Letters Patent is hereby corrected as shown below:

Column 8,
Line 10, delete “comers” and insert in place thereof -- corners --.
Line 24, delete “.” following “52”.
Line 45, delete “Bilhofer” and insert in place thereof -- Billhöfer --.

Column 13,
Line 45, delete “farther” and insert in place thereof -- further --.

Signed and Sealed this

Fifth Day of August, 2003

JAMES E. ROGAN
*Director of the United States Patent and Trademark Office*